US008356423B2

(12) United States Patent
Corberan Salvador et al.

(10) Patent No.: US 8,356,423 B2
(45) Date of Patent: Jan. 22, 2013

(54) HOUSEHOLD APPLIANCE CONTAINING A HEAT TRANSFER FLUID

(75) Inventors: Jose Miguel Corberan Salvador, Valencia (ES); Jose Gonzalvez Macia, Picanya (ES); Roberto San Martin Sancho, Estella (ES)

(73) Assignee: BSH Bosch und Siemens Haugeraete GmbH, Munich (DE)

( * ) Notice: Subject to any disclaimer, the term of this patent is extended or adjusted under 35 U.S.C. 154(b) by 485 days.

(21) Appl. No.: 12/681,935

(22) PCT Filed: Oct. 10, 2008

(86) PCT No.: PCT/EP2008/063641

§ 371 (c)(1),
(2), (4) Date: Apr. 7, 2010

(87) PCT Pub. No.: WO2009/053257

PCT Pub. Date: Apr. 30, 2009

(65) Prior Publication Data

US 2010/0212178 A1 Aug. 26, 2010

(30) Foreign Application Priority Data

Oct. 25, 2007 (EP) ..... 07380292

(51) Int. Cl.
*F26B 11/02* (2006.01)

(52) U.S. Cl. ..... 34/108; 34/595; 34/610; 62/241; 8/149.3; 165/158; 15/50

(58) Field of Classification Search ..... 34/100, 34/104, 105, 108, 595, 601, 606, 602, 610; 62/324.3, 241; 8/149.3, 158; 165/104.19, 165/158; 15/40
See application file for complete search history.

(56) References Cited

U.S. PATENT DOCUMENTS 3,218,728 A * 11/1965 Barth et al. ..... 34/292
3,654,705 A * 4/1972 Smith et al. ..... 34/368
(Continued)

FOREIGN PATENT DOCUMENTS

DE 3218728 A1 * 3/1984
(Continued)

OTHER PUBLICATIONS

H. Buchwald; J. Hellmann; H. Koenig; C. Meurer. Solkane-Product Manual Refrigeration and Air-Conditioning Technology. Aug. 2000.

*Primary Examiner* — Stephen M. Gravini
(74) *Attorney, Agent, or Firm* — James E. Howard; Andre Pallapies

(57) ABSTRACT

A household appliance includes a drying chamber, a process air loop and a heat pump. The heat pump includes a heat transfer loop containing a heat transfer fluid, an evaporator heat exchanger, a liquefier heat exchanger, a compressor, and a nozzle. The heat transfer fluid has a critical temperature above 60° C., a nominal heat of vaporization at boiling point of at least 220 kJ/kg, a GWP index of less than 150 and a lower flammability level of at least 0.1 kg/m$^3$. Preferably, the household appliance is a dryer for drying wet laundry.

14 Claims, 2 Drawing Sheets

U.S. PATENT DOCUMENTS

| | | | | |
|---|---|---|---|---|
| 4,237,695 | A * | 12/1980 | Oberpriller et al. | 62/63 |
| 4,749,394 | A * | 6/1988 | Ehrsam | 62/532 |
| 4,876,802 | A * | 10/1989 | Gergely et al. | 34/408 |
| 5,680,711 | A * | 10/1997 | Moratalla | 34/77 |
| 7,404,299 | B2 * | 7/2008 | Drysdale et al. | 62/228.1 |
| 2005/0086824 | A1 * | 4/2005 | Ono et al. | 34/62 |
| 2005/0246920 | A1 * | 11/2005 | Yabuuchi et al. | 34/515 |
| 2006/0179676 | A1 * | 8/2006 | Goldberg et al. | 34/77 |
| 2007/0006601 | A1 | 1/2007 | Thiyagarajan et al. | |
| 2008/0006308 | A1 * | 1/2008 | Classen et al. | 134/95.2 |
| 2010/0212178 | A1 * | 8/2010 | Corberan et al. | 34/108 |
| 2010/0263225 | A1 * | 10/2010 | Balerdi Azpilicueta et al. | 34/134 |
| 2010/0275457 | A1 * | 11/2010 | Balerdi Azpilicueta et al. | 34/86 |
| 2011/0286913 | A1 * | 11/2011 | Lugtigheid | 423/658.2 |

FOREIGN PATENT DOCUMENTS

| | | | |
|---|---|---|---|
| DE | 4237695 | A1 * | 5/1994 |
| DE | 19738735 | C2 | 2/2003 |
| EP | 0467188 | B1 | 4/2001 |
| EP | 1672294 | A2 | 6/2006 |
| EP | 1672295 | A2 | 6/2006 |
| EP | 1964965 | A1 * | 9/2008 |
| EP | 2053159 | A1 * | 4/2009 |
| EP | WO2009053257 | A1 | 4/2009 |
| JP | 8-38795 | A | 2/1996 |
| WO | 2006029953 | A1 | 3/2006 |

* cited by examiner

HOUSEHOLD APPLIANCE CONTAINING A HEAT TRANSFER FLUID

BACKGROUND OF THE INVENTION

The invention relates to a household appliance comprising a drying chamber for drying wet articles therein, a process air loop for circulating process air to dry the articles and a heat pump, said heat pump comprising a heat transfer loop containing a heat transfer fluid to be circulated through said heat transfer loop, an evaporator heat exchanger for transferring heat from the process air into the heat transfer fluid by evaporating said heat transfer fluid, a liquefier heat exchanger for transferring heat from said heat transfer fluid to the process air by liquefying said heat transfer fluid, a compressor for compressing said heat transfer fluid and driving said heat transfer fluid through said heat transfer loop, and a nozzle for decompressing said heat transfer fluid.

A household appliance of this type is apparent from EP 0 467 188 B1. That document contains a detailed description of a household appliance that is configured as a dryer for drying articles which are wet laundry. The document refers to many details of the household appliance that may be necessary or at any rate advantageous in making or using the appliance. Accordingly, the whole content of this document is incorporated herein by reference.

Related art for household appliances is apparent from documents WO 2006/029953 A1 that specifies a dishwasher in relation to a laundry dryer or combined laundry washer and dryer, DE 197 38 735 C2 that discloses a household appliance with a different type of heat pump, EP 1 672 294 A2, and EP 1 672 295 A2, the latter two disclosing air conditioning devices that have cooling circuits which are in some aspects similar to the heat pump considered herein incorporated therein.

Drying of wet articles in a household appliance generally requires evaporating the humidity on the articles and transporting away by means of a current of heated process air. Such process air loaded with evaporated humidity may be discharged from the appliance, or subjected to a condensation process to recover the transported humidity in liquid form for collection and disposal. Such condensation process in turn required to cool the process air, thereby extracting heat. That heat may again be discharged from the appliance simply; in order to keep consumption of energy low however, it may be desired to recover that heat at least to an extent. To that end, a household appliance has been developed that incorporates a heat pump which recovers energy taken from the process air by evaporating a heat transfer fluid, subsequently compressing that heat transfer fluid and releasing heat from it back into the process air which circulates in an essentially closed loop. While it may be expedient or even required to open such process air loop at least occasionally as described in EP 0 467 188 B1, pertinent IEC standards require that a dryer that is claimed to recover humidity by condensation keeps any leakage of humidity below 20% of the total humidity present. Problems still to be encountered with such household appliances incorporating heat pumps are high manufacturing costs, relatively long periods needed to dry convenient charges of laundry or the like, and possible environmental hazards from heat transfer fluids applied in such appliances. To mitigate such hazards that are predominantly related to ozone-destroying properties of such compounds, chlorinated hydrocarbons that had been applied frequently in the past are presently prohibited from use due to pertinent legislation. Two other concerns that have grown to become determinative for the design of heat pump systems containing heat transfer fluids are the Global Warming Potentials of such compounds, that is their effect as infrared backscatterers when dispersed in the atmosphere, and, of course, their flammabilities.

The pickup of humidity from articles to be dried by process air is only effective if the process air is heated over any normal ambient temperature, preferably to a temperature higher than 60° C. That temperature will be brought down by the evaporation process to a somewhat lower temperature. At any rate, a temperature around or above 35° C. at an inlet of an evaporator heat exchanger may be expected to pose a problem to a heat pump of the type specified in the introductory chapter and designed in accordance with practice common in the art of refrigeration, in that compressors and refrigerant fluids (generally specified as "heat transfer fluids" herein) from normal refrigeration practice are not suitable for the purpose. It has been considered to obtain relief by reverting to refrigerants of remarkably high critical temperatures so as to ascertain their function at working temperatures up to 60° C., but no thorough analysis and guidance is available so far. Other measures that have been applied to obtain relief are bringing excess heat out of the appliance, by exhaling warm process air in exchange for cooler air and including additional heat exchangers to take excess heat from the heat transfer fluid. All of these measures, however, introduce further complexity and cost.

The known alkane R290 or propane has pertinent physical properties that make it highly suitable for the application considered herein, and it is noted that propane has already been used in commercially used refrigeration systems. In particular, propane has a Global Warming Potential index ("GWP index" in short hereinafter) of 3 that is remarkably low in comparison to a GWP index of 1300 for the conventional heat transfer fluid R134a. Of course, application of propane which is highly flammable will require dedicated protection of the system against fire hazard. Details of GWP indices of generally known refrigerant compounds are listed in the textbook "Solkane-Product Manual Refrigeration and Air-Conditioning Technology" by H. Buchwald, J. Hellmann, H. König, and C. Meurer, $2^{nd}$ ed. 08/2000. As to a quantitative classification of refrigerants in view of their flammabilities as expressed in a Lower Flammability Level index, reference is made to European Standard document IEC 60335-2-40, "Household and Similar Electrical Appliances—Safety—particular Requirements for Electrical heat Pumps, Air-Conditioners and Dehumidifiers", Edition 4.2 2005-07, Annex BB—Table BB.1. Pertinent information on refrigerants or heat transfer fluids is also available in U.S. Standard ASHRAE 34, including a specific nomenclature for such compounds and a classification on security and toxicity of such compounds.

Also, carbon dioxide or R744 is being considered for application in heat pump systems. While carbon dioxide is not flammable and has a GWP index as low as 1, carbon dioxide has a very low critical temperature that would not allow its application in a heat pump in a household appliance designed according to common practice.

BRIEF SUMMARY OF THE INVENTION

Accordingly, it is an object of the invention to specify a household appliance as defined in the introductory chapter herein that has a heat pump which is detailed in a way so as to alleviate the problems specified above and allows for quicker drying of articles at an appropriate expense.

The present invention provides a solution embodied in the household appliance as defined in the independent claim. Preferred embodiments of the invention are defined in the dependent claims.

According to the invention, there is specified a household appliance comprising a drying chamber for drying wet articles therein, a process air loop for circulating process air to dry the articles and a heat pump, said heat pump comprising a heat transfer loop containing a heat transfer fluid to be circulated through said heat transfer loop, an evaporator heat exchanger for transferring heat from the process air into said heat transfer fluid by evaporating said heat transfer fluid, a liquefier heat exchanger for transferring heat from said heat transfer fluid to the process air by liquefying said heat transfer fluid, a compressor for compressing said heat transfer fluid and driving said heat transfer fluid through said heat transfer loop, and a nozzle for decompressing said heat transfer fluid, wherein said heat transfer fluid has a critical temperature above 60° C., a nominal heat of vaporization at boiling point of at least 220 kJ/kg, a GWP index of less than 150 and a lower flammability level of at least 0.1 kg/m$^3$ In accordance with the invention, it has been found that a heat transfer fluid may be used which combines a high critical temperature and a remarkably high volumetric heat capacity as an effective basis for a drying process in a household appliance with application-related environmental properties conforming to pertinent general needs. In particular, application of a heat transfer fluid is taught that, though flammable, will reduce a hazard potential by a factor of at least 3 in comparison to the hazard potential offered by propane. Further, the GWP index of the heat transfer fluid selected in accordance with the invention is reduced by a factor of around 10 in comparison to the GWP index of a conventional heat transfer fluid like R134a, R407C and R410A. Indeed, the predominantly high nominal heat of vaporization at boiling point (to be determined at normal pressure, namely 1 bar or 101.3 kPa) of the heat transfer fluid assures that heat can be absorbed from the process air effectively. The effective absorption of heat by the heat transfer fluid also promotes acceleration of the drying process as a whole, so as to alleviate the problem of long duration of the drying process as experienced in prior art appliances with heat pumps.

In a preferred embodiment of the invention, the household appliance's drying chamber is a rotatable drum. More preferred, the household appliance is configured as a dryer for drying wet laundry.

In another preferred embodiment of the invention, the compressor is a rotary compressor. In such rotary compressor, the heat transfer fluid being compressed is kept at a steady flow without vortices and other discontinuities occurring at a major extent. Most important, excess import of heat into the heat transfer fluid prior to being compressed is avoided, which results in an overall improvement of the figure of merit of the compression process. In addition, the reduced temperature of the heat transfer fluid admitted for compression results in a larger mass flow within the heat transfer loop, yielding a further improvement in heat transport capacity, or allowing use of a somewhat smaller compressor. On one hand, such improved compressor will be somewhat more costly than a more usual compressor with a machine having reciprocating pistons. On the other hand, such improved compressor keeps any additional heating of the heat transfer fluid predominantly low, thereby mitigating excess temperatures within the heat pump.

In a further preferred embodiment of the invention, the heat transfer fluid has a critical temperature above 105° C.

In yet another preferred embodiment of the invention, the heat transfer fluid has a nominal heat of vaporization at boiling point between 230 kJ/kg and 440 kJ/kg.

In still another preferred embodiment of the invention, said heat transfer fluid has a GWP index between 100 and 150.

In still a further preferred embodiment of the invention, said heat transfer fluid has a lower flammability level of at least 0.12 kg/m$^3$.

In yet a further embodiment of the invention, the heat transfer fluid comprises at least one fluorinated hydrocarbon compound. Still more preferred, such heat transfer fluid is refrigerant R152a as specified under ASHRAE 34 or DIN 8960 standards.

In still another preferred embodiment of the invention, the heat pump has a nominal cooling power between 500 W and 3.500 W, thus complying with needs established for application in a household appliance determined to dry wet laundry. Yet more preferred and also in view of the application just specified, the heat pump has a nominal cooling power between 1.500 W and 3.000 W.

In still a further preferred embodiment of the invention, the evaporator heat exchanger has a nominal process air inlet temperature of at least 35° C., thus allowing application of the invention in a household appliance at predominantly high level of temperature, well above levels as usual in refrigeration or air conditioning systems.

In yet another preferred embodiment of the invention, the liquefier heat exchanger has a nominal process air outlet temperature of less than 70° C.; thereby it is demonstrated that the invention incorporates a particularly high degree of temperature control within the heat pump, to alleviate any need for additional temperature control in a household appliance where the heat pump has to operate at a predominantly high level of temperature, without an apparent need to resort to additional heat exchangers or other means to dispose of excess heat.

BRIEF DESCRIPTION OF THE DRAWINGS

An exemplary preferred embodiment of the invention is now described with reference to the accompanying drawing, wherein.

DETAILED DESCRIPTION OF EXEMPLARY EMBODIMENTS OF THE PRESENT INVENTION

Figure 1:
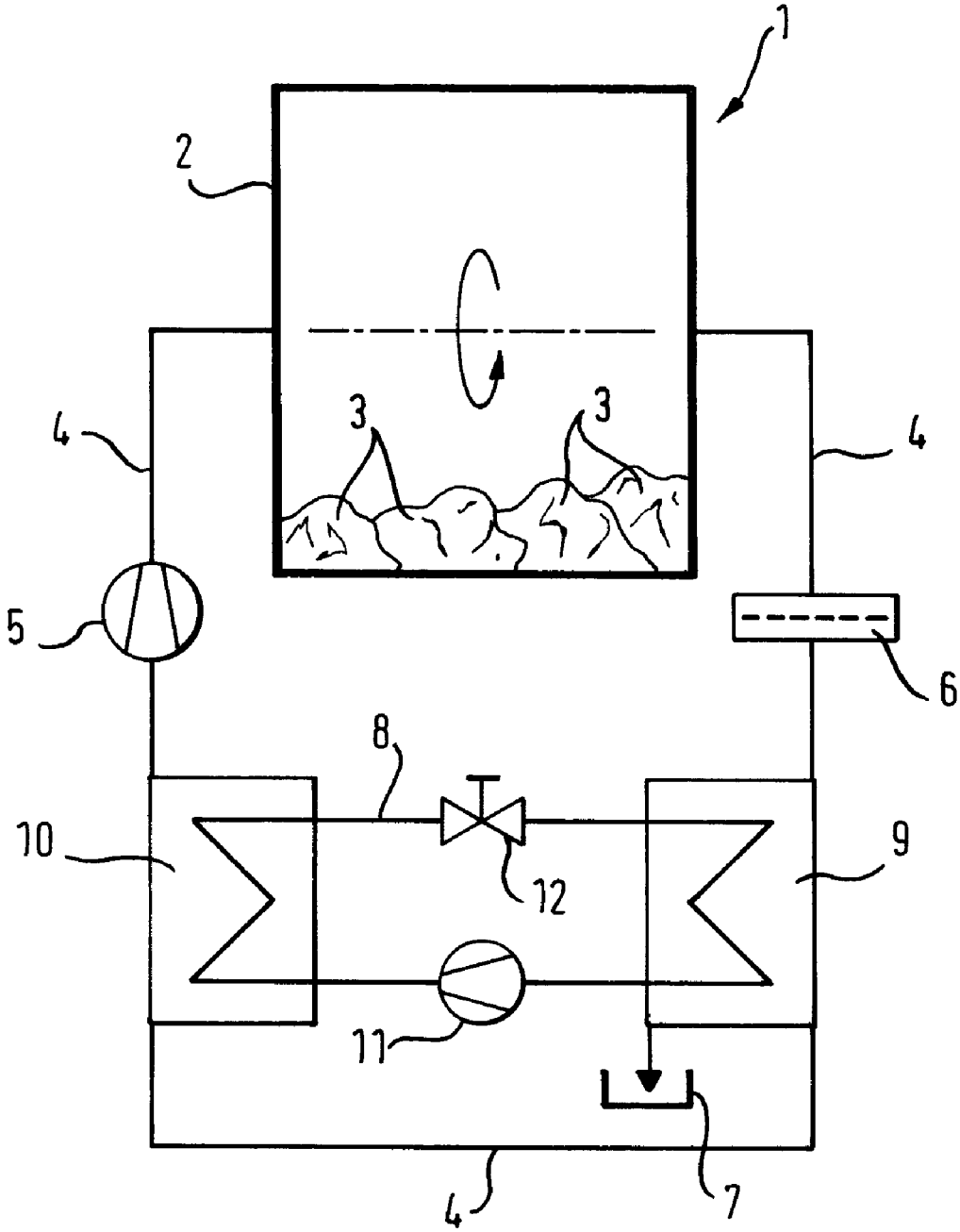
FIG. 1 shows a household appliance configured as a dryer for drying laundry.

The drawing has to be understood to be a sketch showing only such details as are necessarily required for the description subsequent hereto. For further details and indications on how to put the invention into practice, reference is made to the prior art documents cited herein and the pertinent knowledge of a person skilled in the art.

FIG. 1 shows a household appliance 1 embodied as a dryer 1 for drying wet laundry 3. It should be noted that such dryer 1 may be an appliance determined for drying solely, or an appliance determined for both washing and drying.

The dryer 1 comprises a drying chamber 2 embodied as a rotatable drum 2 for retaining wet laundry 3 to be dried by a flow of process air circulating in a closed process air loop 4. Process air is driven in a clockwise direction through said process air loop 4 by a blower 5. It should be noted that the placing of the blower 5 directly adjacent to the drum 2 is only exemplary. Subsequent to traversing the drum 2, the process air having taken up humidity from the laundry 3 being tumbled by rotation of the drum 2 traverses a lint filter 6, in order to catch lint released from the laundry 3 and prevent further components within the process air loop 4 from clogging. By cooling the process air after having traversed the lint filter 6, humidity contained therein is brought to condensation. Condensate thus obtained is stripped from the process air and collected in condensate collector 7 for disposal after the drying process has been accomplished. Subsequent to cooling and removal of condensate, the process air is heated again and conveyed back to the drum 2 by blower 5, to pick up more humidity and thus dry the laundry 3.

Sequential cooling and heating of the process air circulating in the process air loop 4 are accomplished by a heat pump 8, 9, 19, 11, 12 comprising a heat transfer loop 8 that contains a heat transfer fluid or refrigerant, namely the fluorinated hydrocarbon compound R152a. The heat transfer fluid is circulated through evaporator heat exchanger 9 and liquefier heat exchanger 10. In evaporator heat exchanger 9, the heat transfer fluid absorbs heat from the process air carrying humidity take up in the drum 2. The resulting cooling of the process air results in that humidity condensates to be stripped off and conveyed to condensate collector 7 for later disposal. Details of this are well known in the art and are not detailed in FIG. 1 accordingly.

The heat transfer fluid R152a combines a high critical temperature of 113.26° C. and a remarkably high volumetric heat capacity of 329.5 kJ/kg as an effective basis for a drying process in a household appliance with application-related environmental properties conforming to pertinent general needs, namely a GWP index of only 140 and a lower flammability level of 0.13 kg/m$^3$. Application of that heat transfer fluid reduces a hazard potential by a factor of at least 3 in comparison to the hazard potential offered by propane. In practice, this means that a much larger leakage of R152a is needed in comparison to a leakage of propane to establish a real fire hazard by creating a mixture of heat transfer fluid and air that could be ignited by an inadvertent spark or the like. Further, the GWP index of R152a is reduced by a factor of around 10 in comparison to the GWP index of a conventional heat transfer fluid like R134a, R407C and R410A. Indeed, the predominantly high nominal heat of vaporization at boiling point (to be determined at normal pressure, namely 1 bar or 101.3 kPa) of R152a assures that heat can be absorbed from the process air effectively. The effective absorption of heat by the heat transfer fluid also promotes acceleration of the drying process as a whole.

The resulting heating of the heat transfer fluid which reaches the evaporator heat exchanger 9 in liquid phase results in the heat transfer fluid to evaporate. The heat transfer fluid leaves the evaporator heat exchanger 9 in gas phase through a respective portion of the heat transfer loop 8 and reaches the compressor 11 which is a rotary compressor 11. Such rotary compressor 11 is available as a staple commercial product and detailed to some extent in FIG. 2, as explained hereinbelow. In the compressor 11, the heat transfer fluid is compressed and forwarded to the liquefier heat exchanger 10, where it transfers heat to the process air arriving from the evaporator heat exchanger 9 as well, and condensates to its liquid state again. Subsequently, the heat transfer fluid passes a nozzle 12 where it is decompressed to a lower pressure level, to enter the evaporator heat exchanger 9 again for absorbing more heat from the process air arriving from the lint filter 6, and completing its circuit. After having absorbed heat in the liquefier heat exchanger 10, the process air is conveyed back to the drum 2 to absorb more humidity from the laundry 3, to complete its own circuit.

Preferred temperature ranges for the heat transfer fluid or the process air have been specified hereinbefore and are not repeated at this point.

Figure 2:
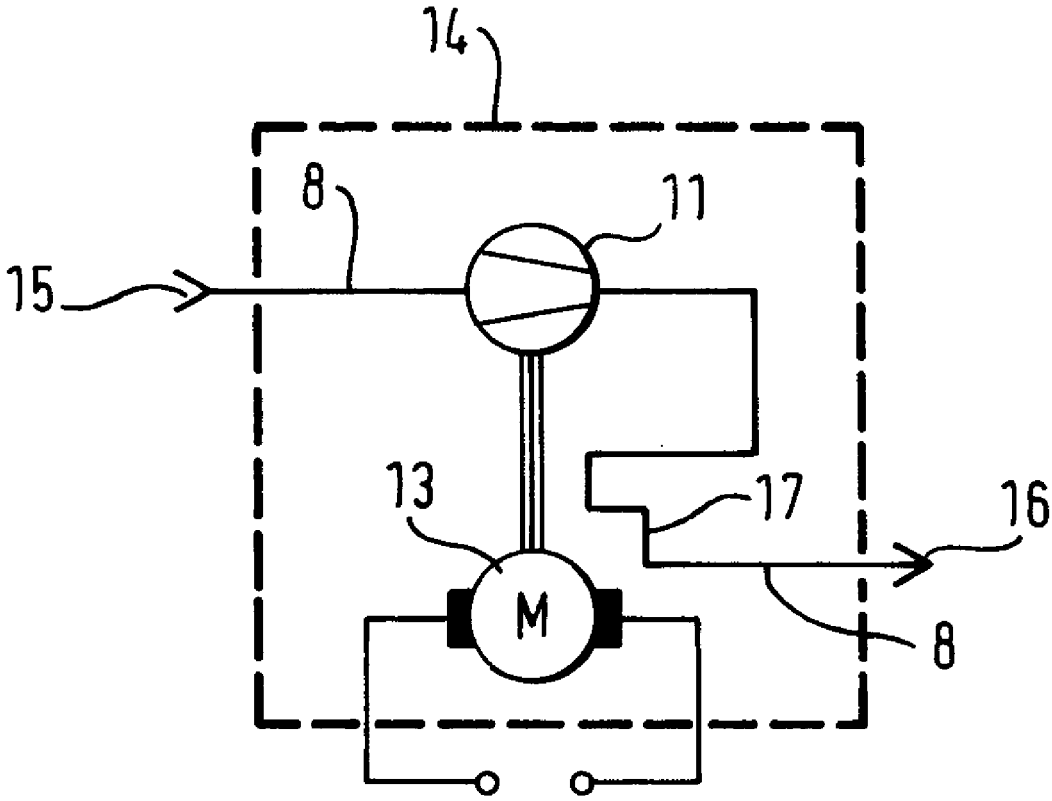
FIG. 2 shows a compressor configuration.

Details of an arrangement comprising the rotary compressor 11 are shown in FIG. 2. Accordingly, the compressor 11 in itself is driven by an electric motor 13. The compound of the compressor 11 and the motor 13 is contained in a housing 14, and traversed by the heat transfer loop 8 from an inlet 15 to an outlet 16. The housing 14 also contains an internal cooler 17 for cooling the motor 13 and the compressor 11. That cooler 17 is fed by heat transfer fluid exiting the compressor 11, according to common practice for rotary compressors 11. In contrast to usual practice with reciprocating compressors, the heat transfer fluid upon entry via the inlet 15 does not flood the whole of the housing 14 prior to admission into the compressor 11, so as to provide cooling for the motor 13 and mechanical parts of the compressor 11. That type of cooling, though quite effective in general, provides for heating up the heat transfer fluid prior to its compression and thus impairs the effectivity of the compression process. Accordingly, resort is made presently to cooling the motor 13 and the compressor 11 by heat transfer fluid after compression, which introduces its own limitations but assures an effective compression process, which improves the heat transfer process in turn.

At any rate, the household appliance having a heat pump as disclosed herein features a specific selection of functional components of the heat pump that assures a delicate balance of heat generation and transfer in application to a drying purpose and related operation on one hand with considerations relating to functional safety and environment on the other hand, to assure smooth and highly efficient operation at a properly limited expense in manufacturing and operation.

LIST OF REFERENCE NUMERALS

1 Household appliance, dryer
2 Drying chamber, drum
3 Wet articles, laundry
4 Process air loop
5 Blower
6 Lint filter
7 Condensate collector
8 Heat transfer loop
9 Evaporator heat exchanger
10 Liquefier heat exchanger
11 Compressor
12 Nozzle
13 Drive motor
14 Compressor housing
15 Compressor inlet
16 Compressor outlet
17 Internal cooler

The invention claimed is:

1. A household appliance comprising:
a drying chamber for drying wet articles;
a process air loop for circulating process air to dry the articles; and
a heat pump comprising:
a heat transfer loop containing a heat transfer fluid to be circulated through the heat transfer loop;
an evaporator heat exchanger for transferring heat from the process air into the heat transfer fluid by evaporating the heat transfer fluid;
a liquefier heat exchanger for transferring heat from the heat transfer fluid to the process air by liquefying the heat transfer fluid;

a compressor for compressing the heat transfer fluid and driving the heat transfer fluid through the heat transfer loop; and a nozzle for decompressing the heat transfer fluid, wherein the heat transfer fluid has a critical temperature above 60° C., a nominal heat of vaporization at boiling point of at least 220 kJ/kg, a GWP index of less than 150 and a lower flammability level of at least 0.1 kg/m$^3$.

2. The household appliance of claim 1, wherein said drying chamber comprises a rotatable drum.

3. The household appliance of claim 2, which is configured as a dryer for drying wet laundry.

4. The household appliance of claim 1, wherein said compressor comprises a rotary compressor.

5. The household appliance of claim 1, wherein said heat transfer fluid has a critical temperature above 105° C.

6. The household appliance of claim 1, wherein said heat transfer fluid has a nominal heat of vaporization at a boiling point between 230 kJ/kg and 440 kJ/kg.

7. The household appliance of claim 1, wherein said heat transfer fluid has a GWP index between 100 and 150.

8. The household appliance of claim 7, wherein said heat transfer fluid comprises refrigerant R152a.

9. The household appliance of claim 1, wherein said heat transfer fluid has a lower flammability level of at least 0.12 kg/m$^3$.

10. The household appliance of claim 1, wherein said heat transfer fluid comprises a fluorinated hydrocarbon compound.

11. The household appliance of claim 1, wherein said heat pump has a nominal cooling power between 500 W and 3,500 W.

12. The household appliance of claim 11, wherein said heat pump has a nominal cooling power between 1,500 W and 3,000 W.

13. The household appliance of claim 1, wherein said evaporator heat exchanger has a nominal process air inlet temperature of at least 35° C.

14. The household appliance of claim 1, wherein said liquefier heat exchanger has a nominal process air outlet temperature of less than 70° C.

* * * * *